US010837325B2

(12) United States Patent
Geyer

(10) Patent No.: US 10,837,325 B2
(45) Date of Patent: Nov. 17, 2020

(54) LIGHTWEIGHT-CONSTRUCTION ROLLER TAPPET

(71) Applicant: Schaeffler Technologies AG & Co. KG, Herzogenaurach (DE)

(72) Inventor: Norbert Geyer, Höchstadt (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/497,926

(22) PCT Filed: Feb. 1, 2018

(86) PCT No.: PCT/DE2018/100080

§ 371 (c)(1),
(2) Date: Sep. 26, 2019

(87) PCT Pub. No.: WO2018/184621

PCT Pub. Date: Oct. 11, 2018

(65) Prior Publication Data

US 2020/0032678 A1 Jan. 30, 2020

(30) Foreign Application Priority Data

Apr. 3, 2017 (DE) ..... 10 2017 107 100

(51) Int. Cl.
*F01L 1/14* (2006.01)
*F02M 59/10* (2006.01)

(52) U.S. Cl.
CPC ..... *F01L 1/14* (2013.01); *F02M 59/102* (2013.01); *F01L 2305/00* (2020.05)

(58) Field of Classification Search
CPC ..... F01L 1/14; F01L 2105/00; F01L 1/143; F01L 1/146; F02M 59/102
See application file for complete search history.

(56) References Cited

U.S. PATENT DOCUMENTS

| | | | | |
|---|---|---|---|---|
| 3,108,580 A | | 10/1963 | Crane | |
| 3,977,370 A | * | 8/1976 | Humphreys | F01L 1/14 123/90.5 |
| 5,327,860 A | | 7/1994 | Krueger | |
| 6,688,269 B1 | * | 2/2004 | Steinmetz | F01L 1/14 123/90.48 |

(Continued)

FOREIGN PATENT DOCUMENTS

| | | |
|---|---|---|
| AT | 515 737 A1 | 11/2015 |
| DE | 25 40 061 A1 | 5/1976 |

(Continued)

*Primary Examiner* — Thomas C Diaz
(74) *Attorney, Agent, or Firm* — Matthew V. Evans

(57) ABSTRACT

This disclosure relates to a roller tappet, in particular for a high-pressure fuel pump. The roller tappet is guided in a direction of a longitudinal axis thereof in a housing receptacle and is driven in the longitudinal direction by cams of a camshaft. The roller tappet has a tappet body. The tappet body has a tappet skirt, a pump piston contact seat, and a rotatably mounted roller, by means of which the roller tappet is supported on the camshaft. The tappet body has a guide cylinder, which is mounted in the housing receptacle and on which the roller is mounted, and a cup-shaped sleeve having the pump piston contact point, which cup-shaped sleeve is supported axially and radially in the guide cylinder.

14 Claims, 3 Drawing Sheets

(56) References Cited

U.S. PATENT DOCUMENTS

| | | | | |
|---|---|---|---|---|
| 9,556,754 | B2 | 1/2017 | Hattiangadi et al. | |
| 2016/0138541 | A1 | 5/2016 | Hauvespre | |
| 2020/0041018 | A1* | 2/2020 | Geyer ..... | F02M 59/44 |

FOREIGN PATENT DOCUMENTS

| | | | |
|---|---|---|---|
| DE | 41 28 813 | A1 | 3/1993 |
| DE | 43 25 610 | A1 | 2/1995 |
| DE | 10 2005 046670 | A1 | 4/2007 |
| DE | 10 2008 000710 | A1 | 9/2009 |
| DE | 10 2012 223 413 | A1 | 6/2014 |
| DE | 10 2014 214900 | A1 | 2/2016 |
| EP | 0 767 291 | A1 | 4/1997 |
| JP | 2013 217304 | A | 10/2013 |

* cited by examiner

LIGHTWEIGHT-CONSTRUCTION ROLLER TAPPET

CROSS-REFERENCE TO RELATED APPLICATIONS

This application is the U.S. National Phase of PCT Application No. PCT/DE2018/100080 filed on Feb. 1, 2018 which claims priority to DE 10 2017 107 100.8 filed on Apr. 3, 2017, the entire disclosures of which are incorporated by reference herein.

TECHNICAL FIELD

This disclosure relates to a multi-part roller tappet for a high-pressure fuel pump. The roller tappet is guided in the direction of the longitudinal axis thereof in a housing receptacle and is driven movably in the longitudinal direction by cams of a camshaft. The roller tappet includes a tappet body, which has a tappet skirt, a pump piston contact seat and a rotatably mounted roller, by means of which the roller tappet is supported on the camshaft. The tappet body has a guide cylinder, which is mounted in the housing receptacle and on which the roller is supported, and in which the tappet body has a cup-shaped sleeve having a pump piston contact seat, which is arranged within the guide cylinder.

BACKGROUND

A roller tappet of this kind is known from DE 10 2012 223 413 A1. The roller tappet is designed as an integral unit, which is designed for a specific high-pressure fuel pump. If the distance between the camshaft and the pump unit varies, the tappet can be produced with different dimensions. This also applies to extensions of the tappet skirt. However, such modifications are costly.

Moreover, US 2016/0 138 541 A1, DE 25 40 061 A1, AT 515 737 A1, U.S. Pat. No. 9,556,754 B2, EP 0 767 291 A1, U.S. Pat. No. 3,108,580 A and DE 41 28 813 A1 disclose multi-part roller tappets, all of which have a largely hollow-cylindrical guide cylinder, which have at the axial end a roller for rolling against a driving shaft and a cup-shaped sleeve, which is secured in the guide cylinder and has a bearing surface for a pump piston at a seat remote from the roller. Some of these known guide cylinders have a cylindrical constriction in the radially outer lateral surface thereof, and therefore, to avoid deformation of this constricted region, either the cup-shaped sleeve is secured in the guide sleeve axially outside the constriction or the wall thickness of the guide cylinder is so large that pressing the cup-shaped sleeve in does not lead to any change in the dimensions or geometry of the outer lateral surface of the respective guide cylinder, for example. However, a relatively large wall thickness leads to an increased roller tappet mass to be moved, which is judged to be disadvantageous.

SUMMARY

It is an underlying object of the disclosure to present a multi-part roller tappet which is constructed in such a way that there are no disadvantageous changes in the external geometry and external dimensions of the guide cylinder of said tappet when a cup-shaped sleeve is secured in the guide cylinder. Moreover, the roller tappet should be adaptable to various overall lengths and distances between the camshaft and the pump element. Moreover, it should be guided with an accurate fit in the housing receptacle and transmit axial forces acting on it without problems, irrespective of thermal and component-related deformations. Finally, it should be possible to position the cup-shaped sleeve in an accurate way axially during the assembly of the roller tappet.

The disclosure starts from a multi-part roller tappet for a high-pressure fuel pump. The roller tappet is guided in the direction of the longitudinal axis thereof in a housing receptacle and is driven movably in the longitudinal direction by cams of a camshaft. The roller tappet includes a tappet body, which has a tappet skirt, a pump piston contact seat and a rotatably mounted roller, by means of which the roller tappet is supported on the camshaft. The tappet body has a guide cylinder, which is mounted in the housing receptacle and on which the roller is supported, and in which the tappet body has a cup-shaped sleeve having a pump piston contact seat, which is arranged within the guide cylinder.

To achieve the stated object, it is envisaged according to the disclosure that the sleeve has a radially outward-facing radial ring between the axial ends of said sleeve. The guide cylinder has a cylindrical constriction groove at the axial level of the radial ring of the sleeve, and the radial ring of the sleeve is secured on the inner lateral surface of the constriction groove. The sleeve has, on the axial end thereof close to the roller, an end ring with a radially projecting bead. The guide cylinder has two supports in the region of the axial end of said cylinder which is close to the roller. The supports each have a hole to receive a pin, which carries the roller in a rotatably supported manner. The end ring rests axially by means of its radially projecting bead against that end of the two lugs which faces the sleeve.

By virtue of the two-part construction of the roller tappet, it is possible to arbitrarily adjust both the distance between the camshaft and the pump unit—by lengthening the cup-shaped sleeve—and the supporting length of the tappet—by lengthening the guide cylinder. Here, the guide cylinder is embodied with a continuous opening, enabling it to be of lightweight design. The cup-shaped sleeve, which has the pump piston contact seat, is provided with an end ring, by means of which it is supported axially against the guide cylinder close to the roller. The cup-shaped sleeve furthermore has a radial ring, which makes contact with the inner wall of the guide cylinder and is secured there. On its axial end close to the roller, the end ring of the cup-shaped sleeve has a radially projecting bead, which is matched to the end faces of two lugs secured in the guide cylinder, thus allowing good axial support in the region of the roller.

The guide cylinder furthermore has a constriction groove to match the radial ring on the sleeve. This constriction groove, which is embodied as a complete displacement of the wall of the guide cylinder and thus projects on the inner lateral surface, is formed precisely, e.g. by grinding, on its inner lateral surface as a support for the radial ring. The radial ring and hence the cup-shaped sleeve can be press-fitted, adhesively bonded, welded or fixed in a similar way on the inner wall of the constriction groove. The constriction groove is also advantageous because only the inner lateral surface thereof and not the full lateral surface of the guide cylinder has to be machined to give an accurate fit.

Machined into the cup-shaped sleeve, outside the radial ring, is an equalizing opening, which forms a connection between the camshaft chamber and the pump unit. The wall thickness of the cup-shaped sleeve can differ to match the effective force. It is embodied with a dome-shaped support at the pump piston contact seat and below the latter. The guide cylinder can be embodied in such a way that it ends after the constriction groove. However, it can also be embodied in such a way that there is a further region provided above the constriction groove, resulting in improved guidance of the guide cylinder in the housing receptacle. In particular, tilting of the guide cylinder in the housing receptacle is thereby avoided.

DETAILED DESCRIPTION

Figure 2:
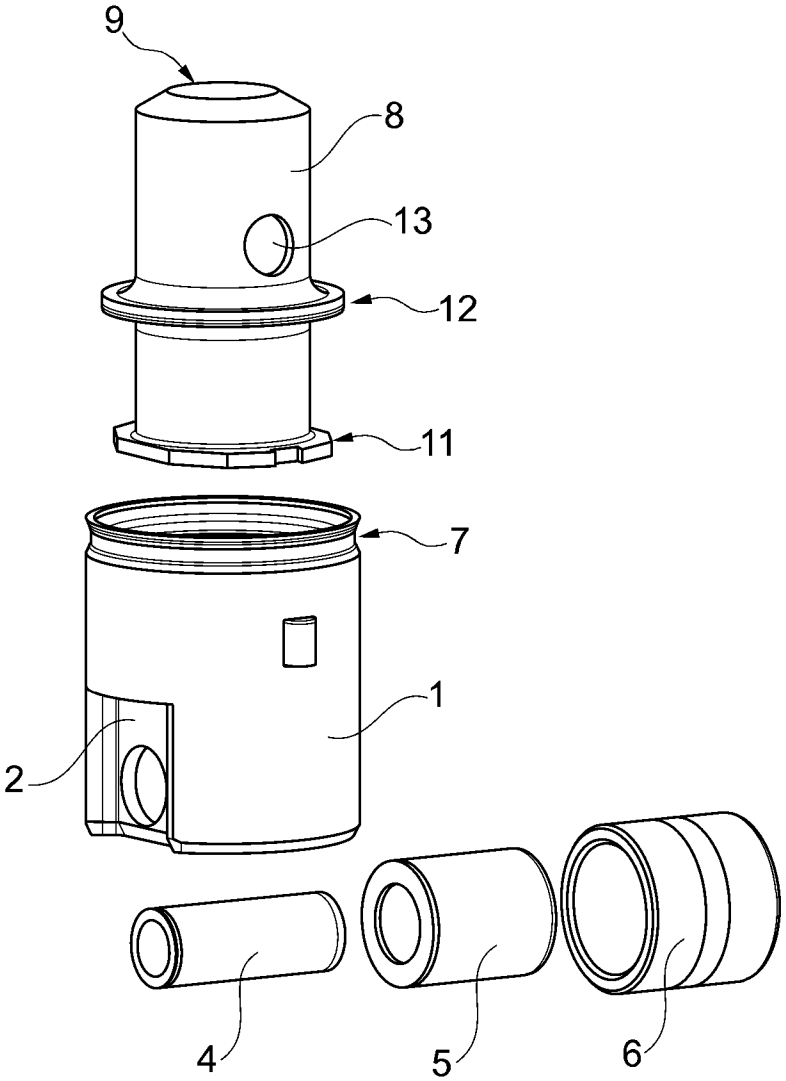
FIG. 2 shows the roller tappet according to FIG. 1 and the components thereof in an exploded illustration.
Figure 1:
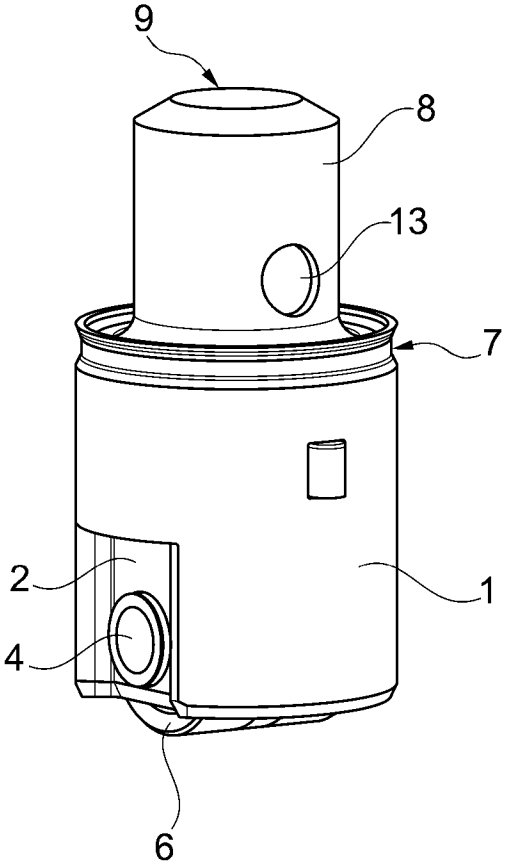
FIG. 1 shows a perspective view of a roller tappet according to the disclosure.
Figure 4:
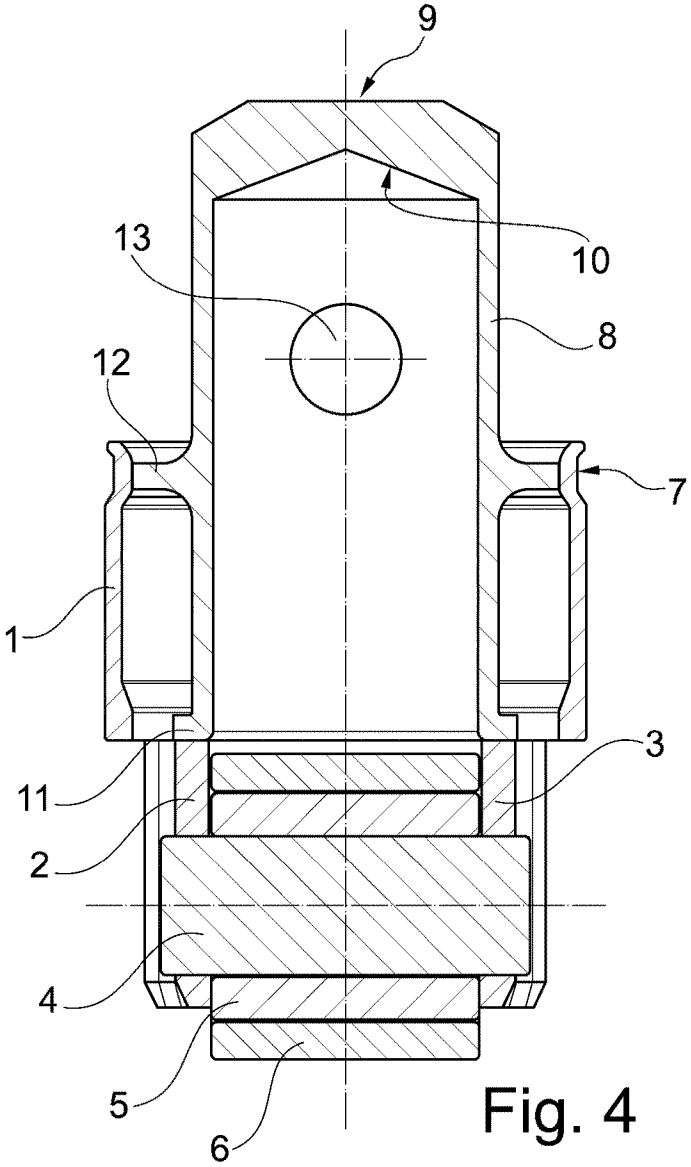
FIGS. 3 and 4 show sections through the roller tappet according to FIG. 1, which are rotated through 90° relative to one another.
Figure 3:
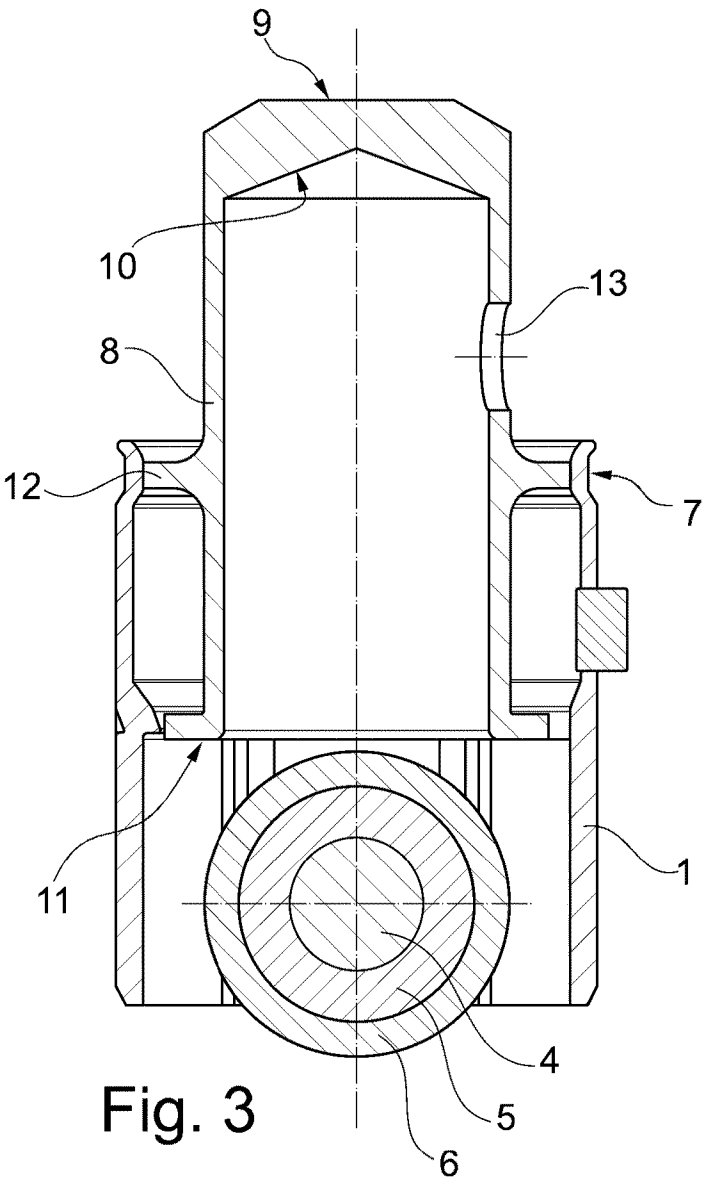
Figure 6:
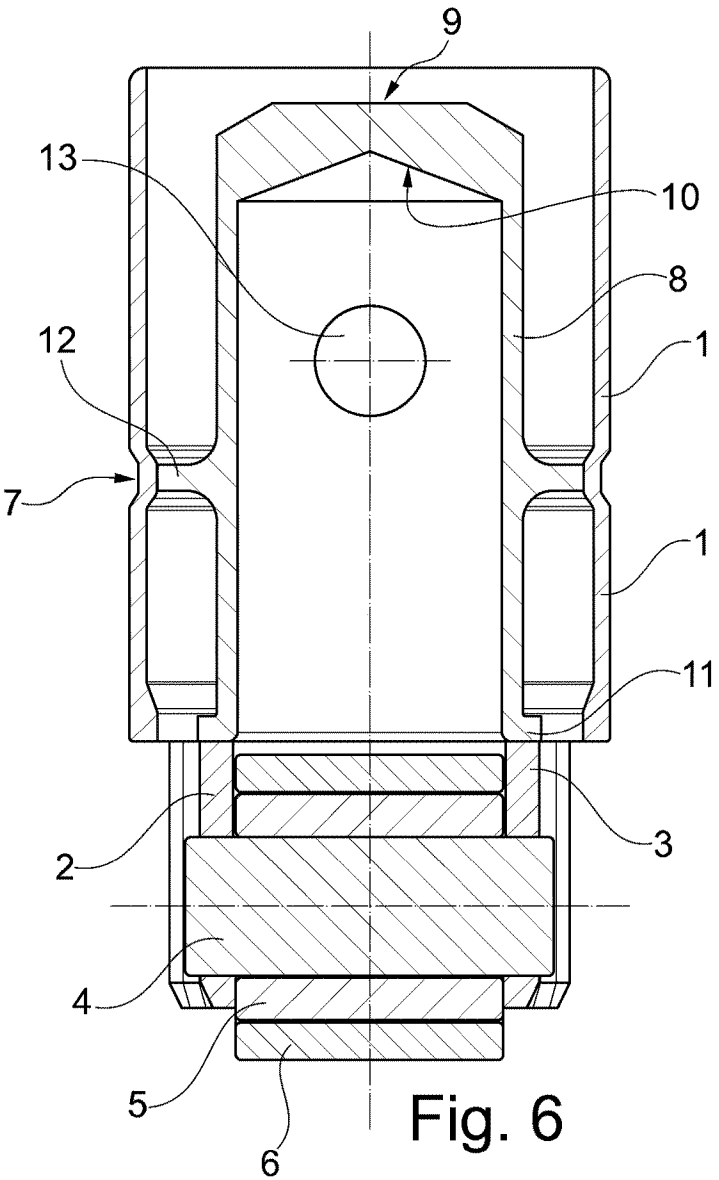
FIGS. 5 and 6 show sections through a roller tappet similar to those in FIGS. 3 and 4, but where the guide cylinder is extended at the end remote from the roller.
Figure 5:
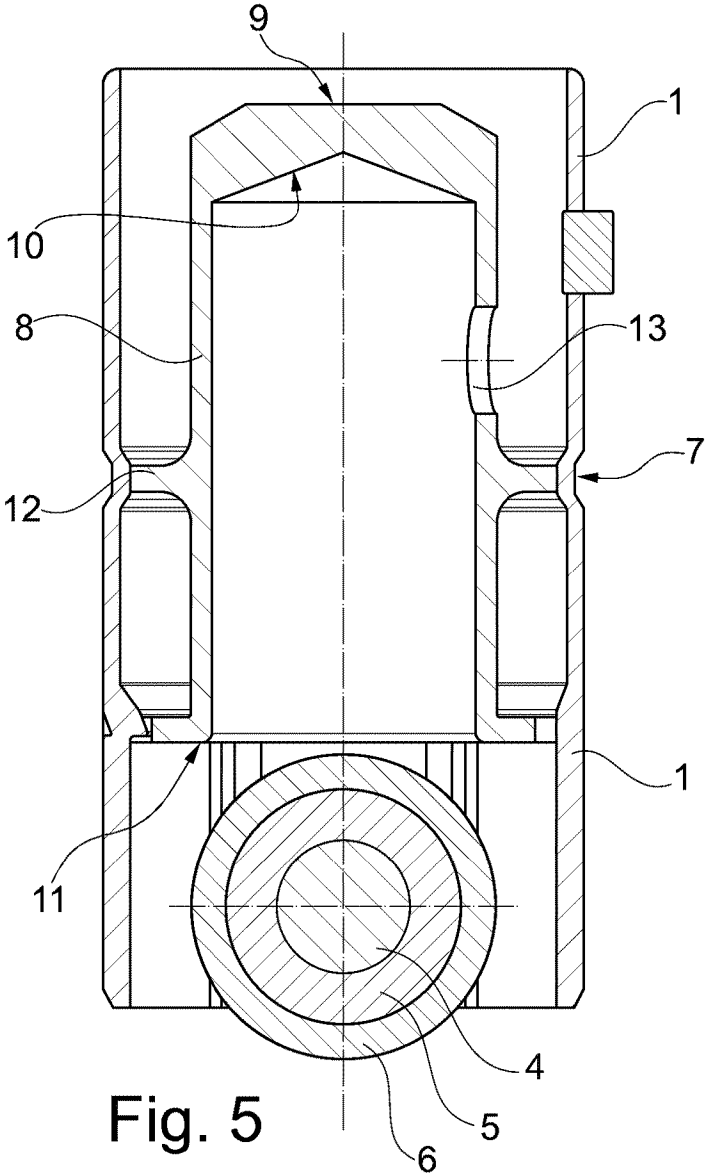

In FIGS. 1 to 6, where illustrated in detail, 1 denotes a guide cylinder, which has supports 2 and 3, on which a pin 4, a bearing sleeve 5 and a roller 6 are mounted. At a distance from the roller 6, the guide cylinder 1 has a constriction groove 7. In the illustrative embodiments according to FIGS. 1 to 4, the guide cylinder 1 is of short design and ends at the end of the constriction groove 7. However, according to FIGS. 5 and 6, it is also possible for the guide cylinder 1 to be of extended design, there thus being a further lateral surface region adjoining the constriction groove 7. Inserted into the guide cylinder 1 is a cup-shaped sleeve denoted by 8, which has, at its upper end, that remote from the roller 6, a pump piston contact seat 9, which has a dome-shaped support 10 with a thick wall. The cup-shaped sleeve 8 is supported in the guide cylinder 1 by means of an end ring 11, wherein the end ring 11 has a radially projecting bead, which is matched to the supporting surface in the guide cylinder 1. A radial ring 12, which is designed to be an accurate fit with the inner wall of the constriction groove 7, is provided on the cup-shaped sleeve 8 at the level of the constriction groove 7. The radial ring 12 can be press-fitted, adhesively bonded, welded or connected in some similar way to the inner lateral surface of the constriction groove 7. In order to provide a pressure balance between the pump unit (not illustrated) and the camshaft chamber (not illustrated), an equalizing opening 13 is machined into the wall of the cup-shaped sleeve 8.

LIST OF REFERENCE CHARACTERS

1 guide cylinder
2, 3 supports
4 pin
5 bearing sleeve
6 roller
7 constriction groove
8 cup-shaped sleeve
9 pump piston contact seat
10 dome-shaped support
11 end ring
12 radial ring
13 equalizing opening

The invention claimed is:

1. A multi-part roller tappet for a high-pressure fuel pump, the roller tappet comprising:

a tappet body including:

a guide cylinder configured to rotatably support a roller, the guide cylinder having a cylindrical constriction groove; and, a cup-shaped sleeve arranged at least partially within the guide cylinder, the cup-shaped sleeve having:

a pump piston contact seat;

a radially outward-facing radial ring arranged between axial ends of the cup-shaped sleeve, the radial ring secured on an inner lateral surface of the constriction groove; and, an end ring with a radially projecting bead, the end ring located in a region of an axial end of the guide cylinder which is close to the roller.

2. The roller tappet as claimed in claim 1, wherein the guide cylinder is configured with a continuous opening.

3. The roller tappet as claimed in claim 1, wherein an equalizing opening is arranged in the cup-shaped sleeve.

4. The roller tappet as claimed in claim 1, wherein the cup-shaped sleeve has a dome-shaped support at the pump piston contact seat.

5. The roller tappet as claimed in claim 1, wherein the guide cylinder extends beyond the constriction groove at an end of the guide cylinder remote from the roller.

6. The roller tappet as claimed in claim 1, wherein the inner lateral surface of the constriction groove projects radially inward.

7. The multi-part roller tappet as claimed in claim 1, wherein the radial ring is secured on the inner lateral surface of the constriction groove by one of either a press-fit, adhesive bond, or a weld.

8. The multi-part roller tappet as claimed in claim 1, wherein the radially projecting bead rests axially against two supports arranged within the guide cylinder.

9. A multi-part roller tappet for a high-pressure fuel pump, the roller tappet comprising:

a tappet body including:

a guide cylinder configured to rotatably support a roller, the guide cylinder having a cylindrical constriction groove; and, a cup-shaped sleeve arranged at least partially within the guide cylinder, the cup-shaped sleeve having:

a pump piston contact seat, the pump piston contact seat and the roller located at opposite ends of the roller tappet; and, a radially outward-facing radial ring arranged between axial ends of the cup-shaped sleeve, the radial ring secured on an inner lateral surface of the constriction groove.

10. The multi-part roller tappet as claimed in claim 9, wherein the guide cylinder further comprises two supports, each of the two supports having a hole that receives a pin which rotatably supports the roller.

11. The multi-part roller tappet as claimed in claim 9, wherein a lateral surface region of the guide cylinder extends beyond the constriction groove at an end remote from the roller.

12. The multi-part roller tappet as claimed in claim 11, wherein the lateral surface region of the guide cylinder extends beyond the pump piston contact seat.

13. A multi-part roller tappet for a high-pressure fuel pump, the roller tappet comprising:

a tappet body including:

a guide cylinder configured to rotatably support a roller, the guide cylinder having a cylindrical constriction groove; and, a cup-shaped sleeve arranged at least partially within the guide cylinder, the cup-shaped sleeve having:

a pump piston contract seat;

a radially outward-facing radial ring arranged between axial end of the cup-shaped sleeve, the radial ring secured on an inner lateral surface of the constriction groove; and, an equalizing opening arranged between the pump piston contact seat and the radial ring.

14. The multi-part roller tappet as claimed in claim 13, wherein the inner lateral surface of the constriction groove projects radially inward.

* * * * *